US011898319B2

(12) United States Patent
Petro et al.

(10) Patent No.: US 11,898,319 B2
(45) Date of Patent: Feb. 13, 2024

(54) REVERSIBLE BUCKET COUPLER FOR EXCAVATOR BUCKETS AND METHOD OF USE

(71) Applicants: Jacob A. Petro, North Huntingdon, PA (US); Jeffrey T. Petro, North Huntingdon, PA (US)

(72) Inventors: Jacob A. Petro, North Huntingdon, PA (US); Jeffrey T. Petro, North Huntingdon, PA (US)

( * ) Notice: Subject to any disclaimer, the term of this patent is extended or adjusted under 35 U.S.C. 154(b) by 402 days.

(21) Appl. No.: 17/379,610

(22) Filed: Jul. 19, 2021

(65) Prior Publication Data

US 2022/0018088 A1 Jan. 20, 2022

Related U.S. Application Data

(60) Provisional application No. 63/053,824, filed on Jul. 20, 2020.

(51) Int. Cl.
*E02F 3/36* (2006.01)
*E02F 3/30* (2006.01)
*E02F 3/32* (2006.01)

(52) U.S. Cl.
CPC ..... *E02F 3/3622* (2013.01); *E02F 3/308* (2013.01); *E02F 3/32* (2013.01); *E02F 3/3631* (2013.01)

(58) Field of Classification Search
None
See application file for complete search history.

(56) References Cited

U.S. PATENT DOCUMENTS 4,311,428 A * 1/1982 Arnold ..... E02F 3/3627 37/444
4,948,328 A * 8/1990 Busch ..... E02F 3/3636 403/4
5,791,863 A * 8/1998 Droegemueller ..... E02F 3/3622 37/468
5,890,871 A * 4/1999 Woerman ..... E02F 3/364 37/468
5,974,706 A * 11/1999 Kaczmarski ..... E02F 3/3627 37/468
5,983,535 A * 11/1999 Kaczmarski ..... E02F 3/3686 37/468
6,123,501 A * 9/2000 Pisco ..... E02F 3/3627 37/468
6,233,852 B1 * 5/2001 Pemberton ..... E02F 3/3668 37/468
6,533,527 B1 * 3/2003 Inoue ..... E02F 3/3659 414/723
7,267,521 B1 * 9/2007 Smith ..... E02F 3/3627 37/468

(Continued)

*Primary Examiner* — Daniel J Wiley
(74) *Attorney, Agent, or Firm* — ACKER WOOD IP LAW, LLC; Gwen R. Acker Wood

(57) ABSTRACT

The present invention provides a reversible bucket coupler device and method of use for reversing the orientation of a bucket used with an excavator so that the teeth of the bucket is facing away from the cab of the excavator and method of use. The reversed orientation of the bucket using the reversible bucket coupler device provides an operator of an excavator the ability to complete tasks in a more efficient, clean and safe manner, as well as providing much needed flexibility in the way excavation projects can be performed.

20 Claims, 10 Drawing Sheets

(56) References Cited

U.S. PATENT DOCUMENTS 7,438,494 B1 * 10/2008 Da Costa ..... E02F 3/3627 37/444
8,287,226 B1 * 10/2012 Westendorf ..... E02F 3/627 403/321
9,945,093 B1 * 4/2018 Belliveau ..... E02F 3/3622
10,119,242 B1 * 11/2018 Faivre ..... E02F 3/627
10,995,469 B1 * 5/2021 Kimble ..... E02F 3/364
D983,843 S * 4/2023 Carson ..... D15/28
2002/0157286 A1 * 10/2002 Fatemi ..... E02F 3/3663 37/403
2002/0176772 A1 * 11/2002 Hung ..... E02F 3/365 414/723
2003/0113159 A1 * 6/2003 Husson ..... E02F 3/3627 403/322.1
2003/0131505 A1 * 7/2003 Heiple ..... E02F 3/3636 37/468
2003/0131682 A1 * 7/2003 Crane ..... E02F 3/3613 403/167
2004/0218971 A1 * 11/2004 Lim ..... E02F 3/3618 403/322.3
2006/0242865 A1 * 11/2006 Herguido Fo ..... E02F 3/3636 37/468
2007/0157492 A1 * 7/2007 Miller ..... E02F 3/3686 37/468
2009/0007465 A1 * 1/2009 Robl ..... E02F 3/365 37/468
2009/0071043 A1 * 3/2009 Hahnel ..... E02F 3/3609 37/468
2009/0087292 A1 * 4/2009 Holloway ..... E02F 3/382 414/723
2009/0107015 A1 * 4/2009 Sakada ..... E02F 3/384 37/440
2013/0216347 A1 * 8/2013 Breuer ..... E02F 3/404 414/739
2015/0225920 A1 * 8/2015 Friedrich ..... E02F 3/3622 403/31
2017/0030048 A1 * 2/2017 Horton ..... E02F 3/3686
2017/0254049 A1 * 9/2017 Kean ..... E02F 3/3604
2017/0350090 A1 * 12/2017 Claesson ..... E02F 3/3618
2018/0002888 A1 * 1/2018 Doyle ..... E02F 3/961
2018/0038062 A1 * 2/2018 Weaver ..... E02F 3/3686
2019/0106858 A1 * 4/2019 Beaudoin ..... E02F 3/3631
2020/0040546 A1 * 2/2020 Jeon ..... E02F 3/365
2020/0048860 A1 * 2/2020 Jang ..... F15B 15/06
2020/0190766 A1 * 6/2020 St-Amant ..... E02F 3/3631
2020/0217040 A1 * 7/2020 Hill ..... E02F 3/3654
2020/0263383 A1 * 8/2020 Kerestes ..... E02F 3/38
2021/0131057 A1 * 5/2021 Miller ..... E02F 3/3618
2021/0164191 A1 * 6/2021 Portus ..... E02F 3/401
2021/0238824 A1 * 8/2021 Anderson ..... E02F 3/3659
2021/0270007 A1 * 9/2021 D'Amours ..... E02F 3/3618
2022/0090346 A1 * 3/2022 Linden ..... E02F 3/3622
2022/0106762 A1 * 4/2022 Friedrich ..... E02F 3/3663

* cited by examiner

REVERSIBLE BUCKET COUPLER FOR EXCAVATOR BUCKETS AND METHOD OF USE

CROSS REFERENCE TO RELATED APPLICATIONS

The present application claims priority to U.S. Provisional Application No. 63/053,824, filed Jul. 20, 2020, which is incorporated herein by reference in its entirety.

FIELD OF THE INVENTION

The present application relates to excavator bucket coupler systems and, in particular to a reversible bucket coupler device capable of reversing the orientation of a bucket with respect to an excavator.

BACKGROUND OF THE INVENTION

Current excavator couplers and coupler arrangements, such as, for example, the X-Change coupler system by Bobcat, do not allow an operator of an excavator to reverse the orientation of the bucket with respect to the front of the excavator. Thus, the standard orientation of the bucket with respect to the cutting edge, i.e., bucket teeth, of the bucket is to face the cab of the excavator. It would be most advantageous to be able to orient a bucket used with excavators in a reverse direction because it would provide the ability to complete tasks in a more efficient, clean and safe manner, as well as providing much needed flexibility in the way excavation projects can be performed.

SUMMARY OF THE INVENTION

The present invention provides a reversible bucket coupler device and method of use for reversing the orientation of a bucket used with an excavator so that the teeth of the bucket is facing away from the cab of the excavator.

In an aspect of the invention, there is provided a reversible bucket coupler device for reversing the orientation of a bucket with respect to an excavator so that bucket teeth are facing away from the excavator. The reversible bucket coupler device is manufactured from steel plate and comprises a first side excavator panel and a second side excavator panel, in which each excavator panel has at one end a hook-like excavator coupler and a pin hole near the other end; a first side bucket panel and a second side bucket panel, in which each bucket panel has at one end an L-shaped bucket coupler and a pin hole near the other end; and a plurality of transverse attachment and support panels. One end of the plurality of transverse attachment and support panels is welded to the first side excavator and bucket panels at a plurality of areas and the other end of the plurality of transverse attachment and support panels is welded to the second side excavator and bucket panels at the same plurality of areas.

In another aspect of the invention, there is provided a method of using the reversible bucket coupler device described above in order to reverse the orientation of a bucket with respect to an excavator so that the bucket teeth are facing away from the excavator. The method comprises attaching the L-shaped bucket couplers between two flanges having a curved portion on one end and a pin hole near the other end, in which each of the two flanges are located at an end of a bucket that is opposite an end where bucket teeth of the bucket are located; and attaching the two hook-like excavator couplers to an excavator by placing the excavator couplers around an excavator joint located on the excavator.

BRIEF DESCRIPTION OF THE DRAWINGS

A fuller understanding of the invention can be gained from the following description when read in conjunction with the accompanying figures, where like reference numerals refer to identical or functionally similar elements throughout the separate views, which illustrate some, but not the only and exclusive, examples of embodiments of the invention and, as such, the figures disclosed herein are to be considered illustrative rather than limiting. In the drawings.

DETAILED DESCRIPTION OF THE INVENTION

The present invention provides a reversible bucket coupler device and method of use for reversing the orientation of a bucket with respect to an excavator so that bucket teeth of the bucket are facing away from the excavator.

Figure 1:
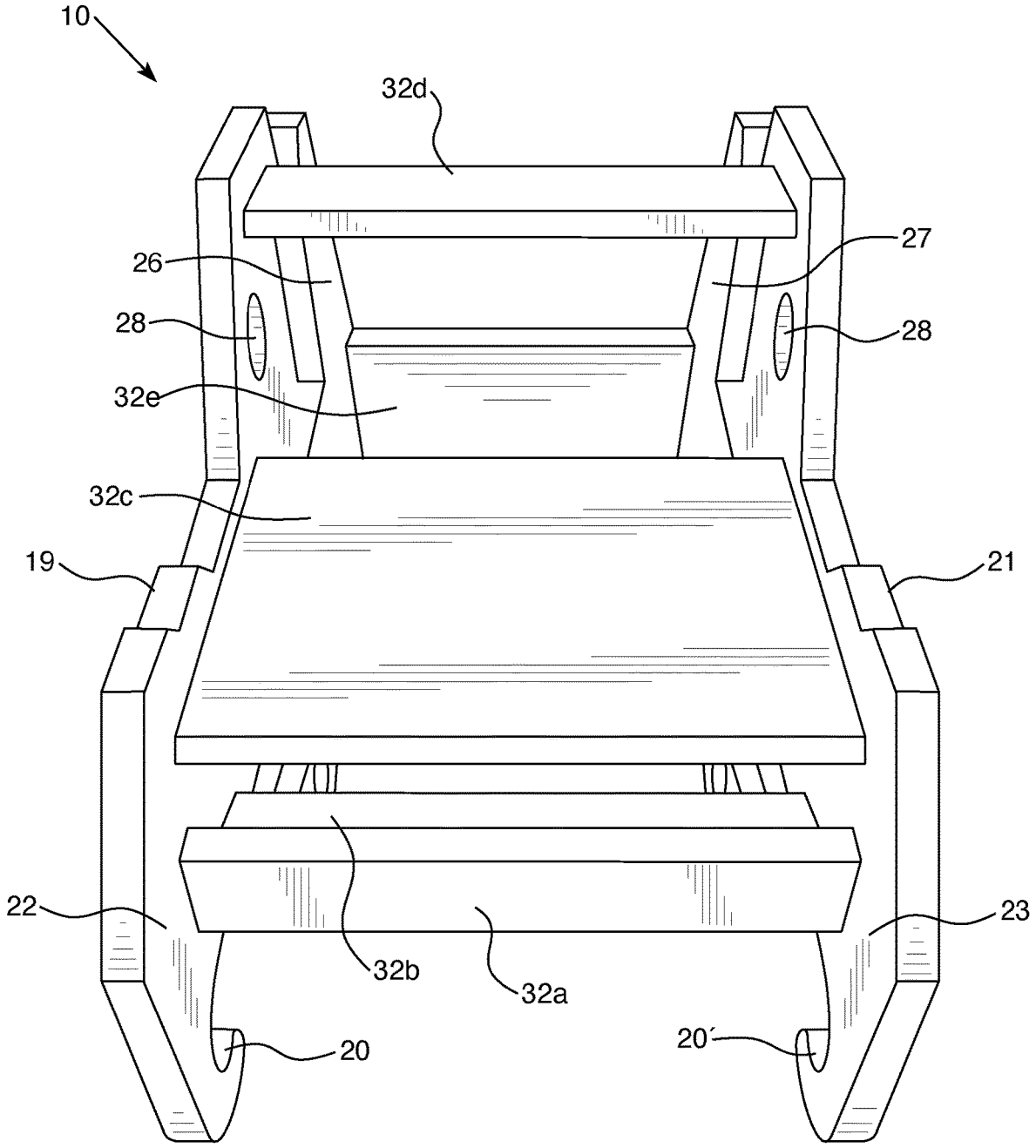
FIG. 1 is a perspective front view of the reversible bucket coupler device in accordance with an embodiment of the invention.
Figure 2:
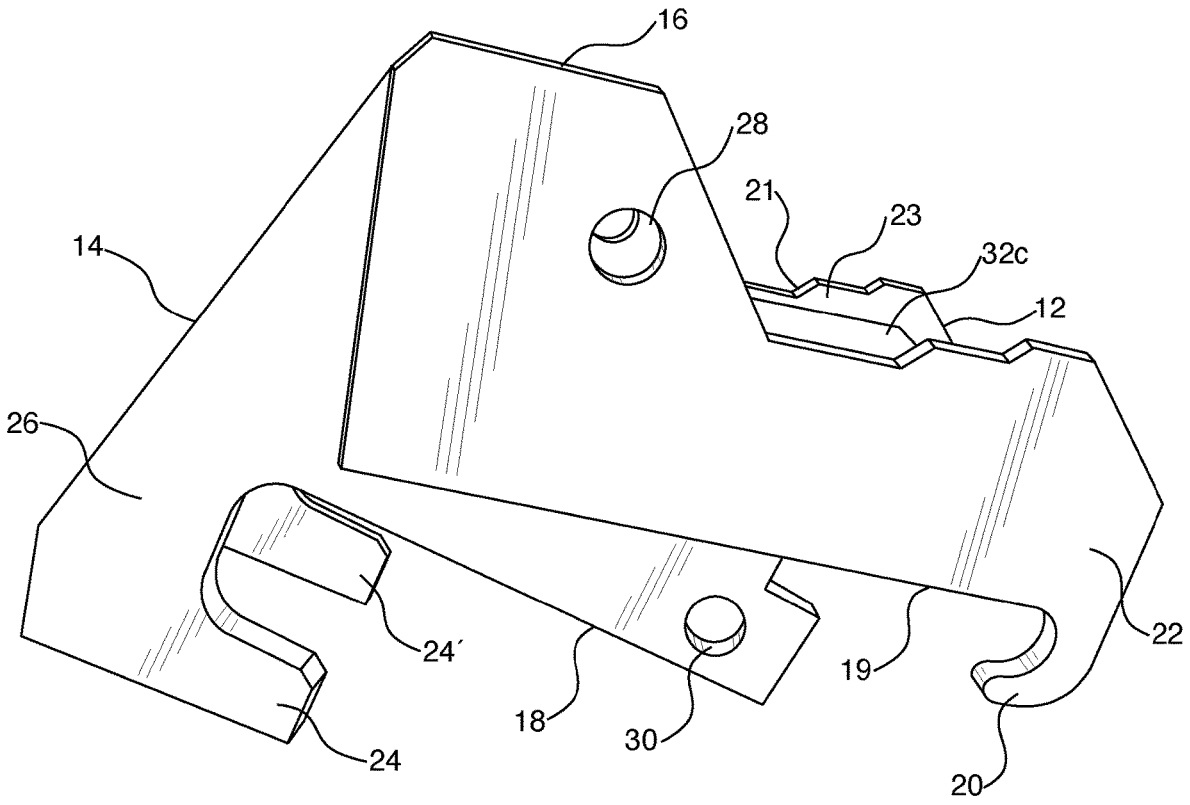
FIG. 2 is a perspective first side view of the reversible bucket coupler device in accordance with an embodiment of the invention.
Figure 3:
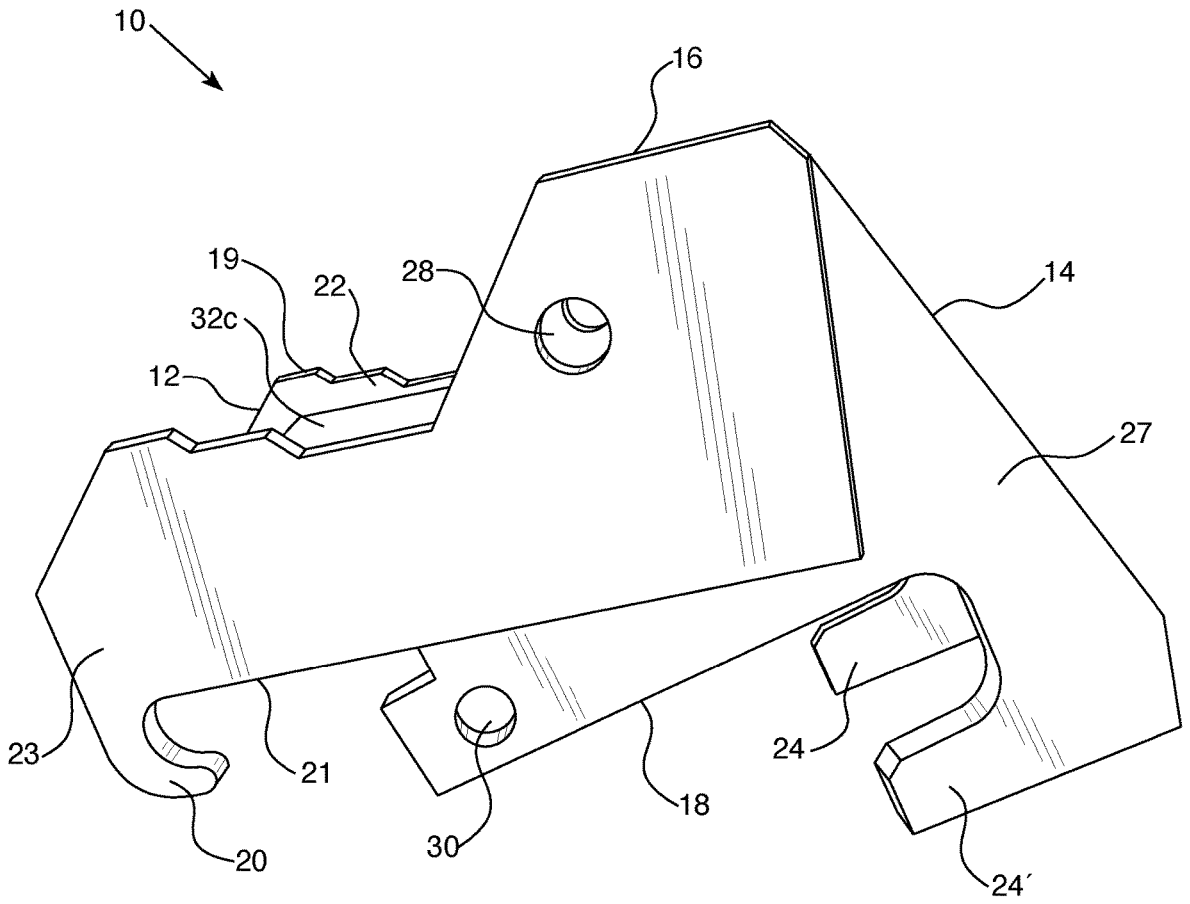
FIG. 3 is a perspective second side view of the reversible bucket coupler device in accordance with an embodiment of the invention.
Figure 4:
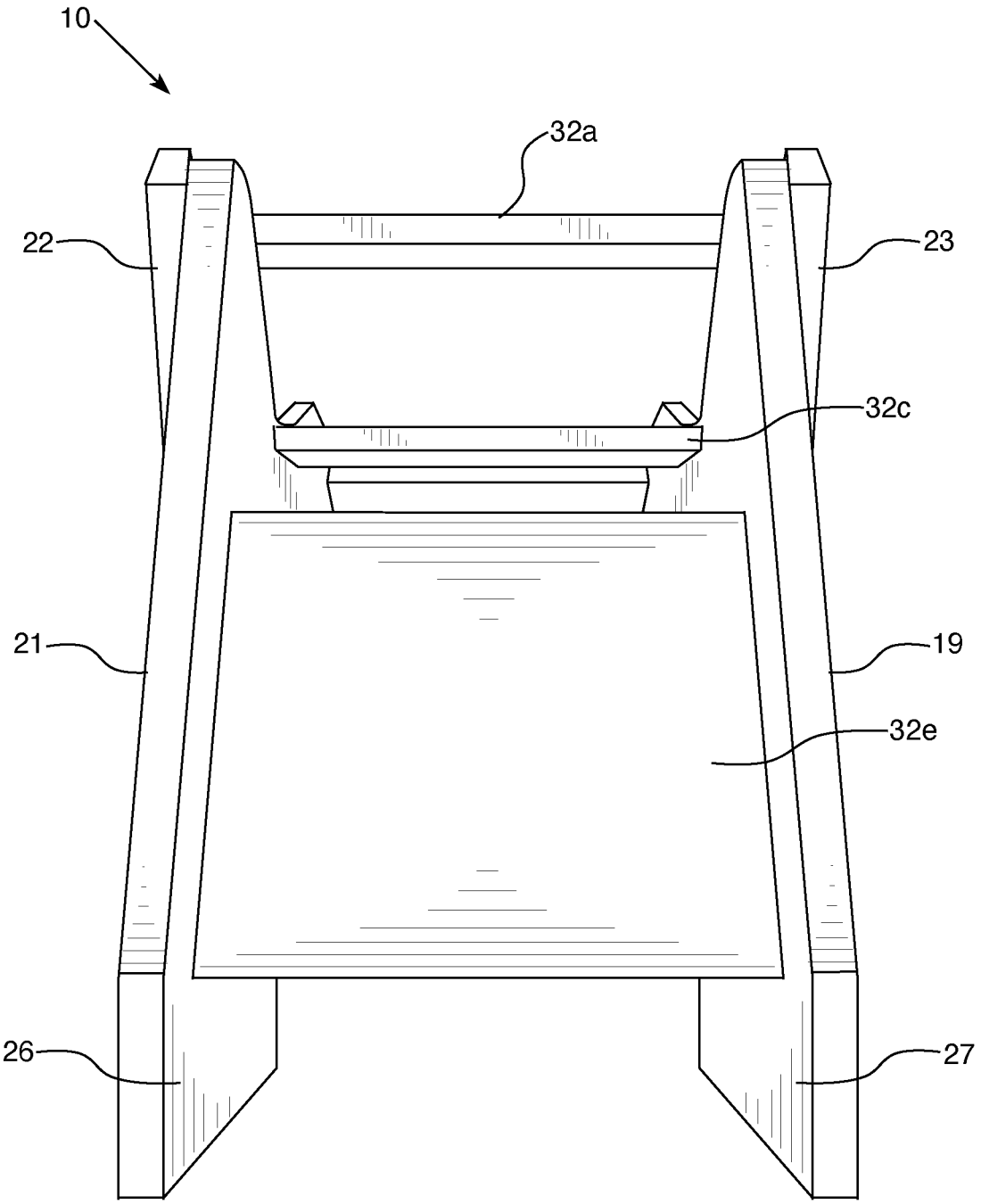
FIG. 4 is a perspective rear view of the reversible bucket coupler device in accordance with an embodiment of the invention.
Figure 5:
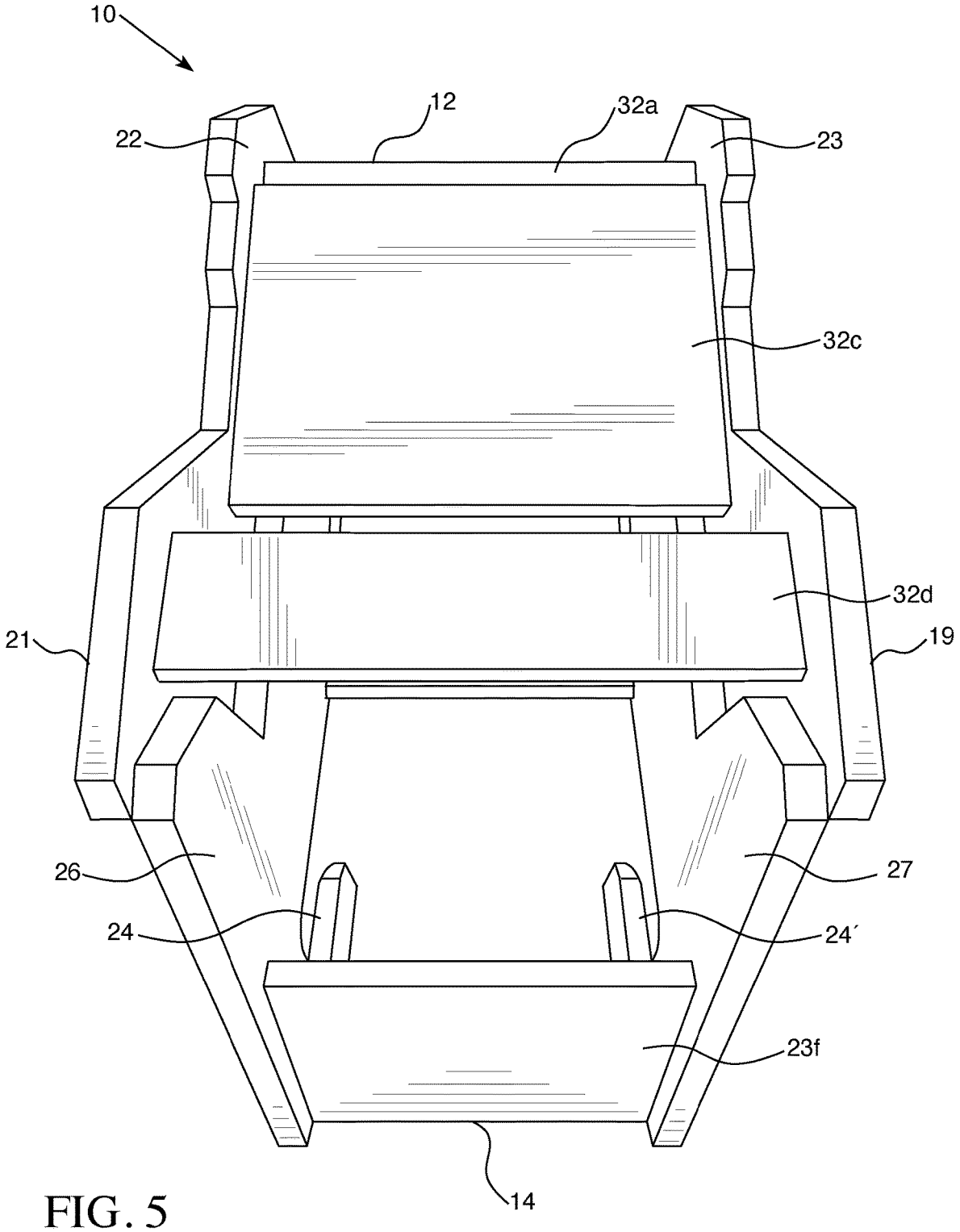
FIG. 5 is a perspective top view of the reversible bucket coupler device in accordance with an embodiment of the invention.
Figure 6:
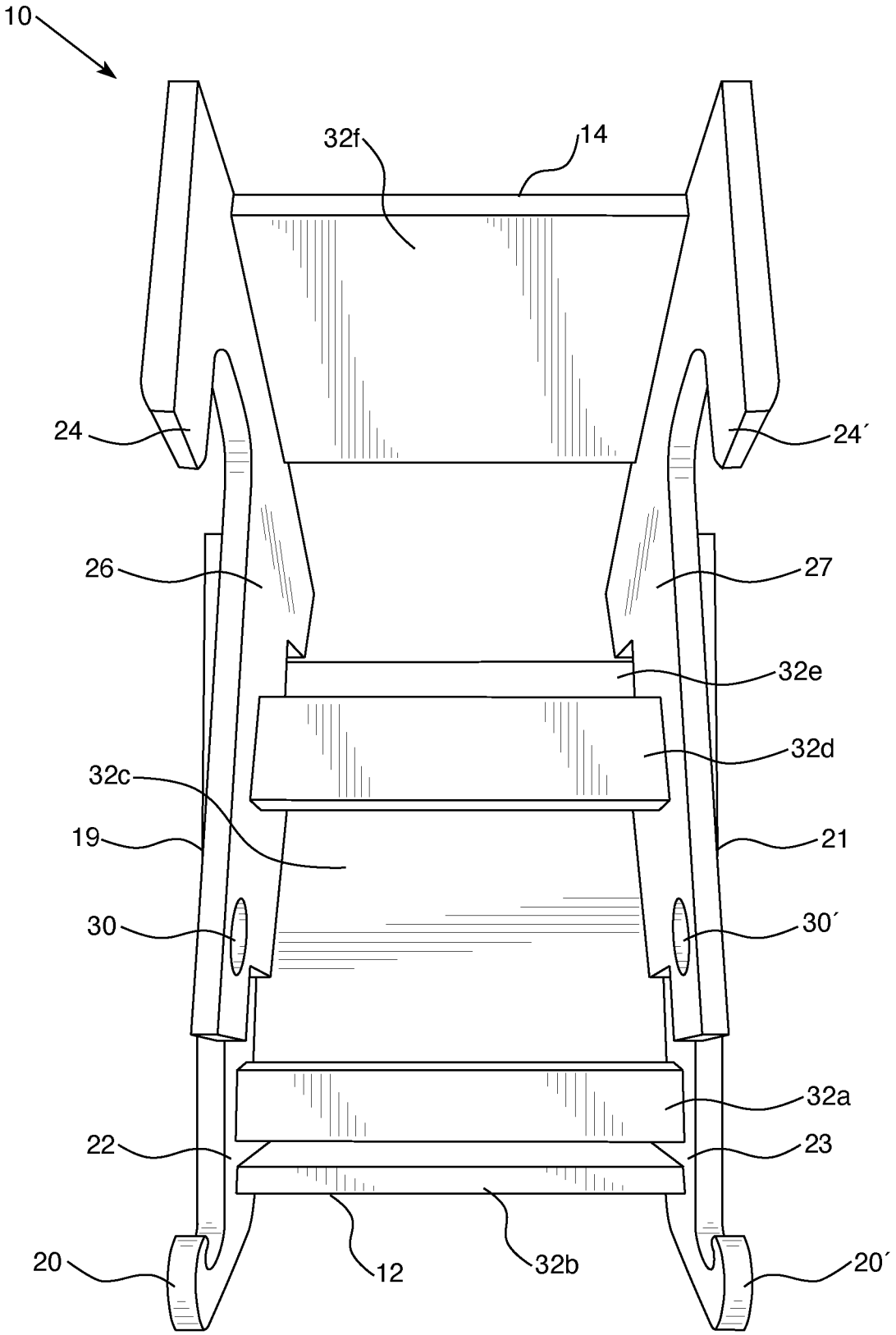
FIG. 6 is a perspective bottom view of the reversible bucket coupler device in accordance with an embodiment of the invention.
Figure 7:
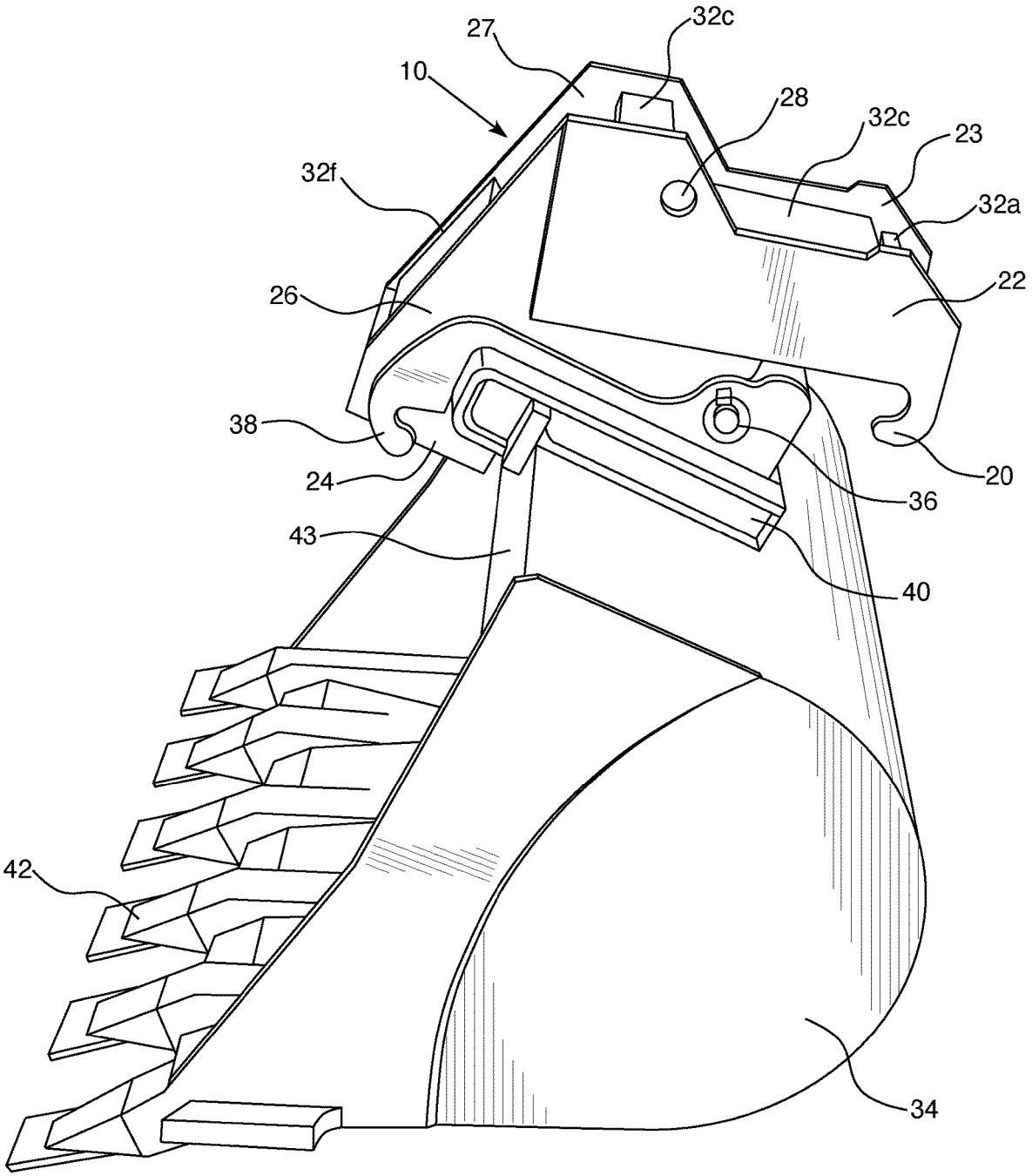
FIG. 7 is a perspective view of the first side of the reversible bucket coupler device attached to an end of a bucket that is opposite bucket teeth of the bucket in accordance with an embodiment of the invention.
Figure 8:
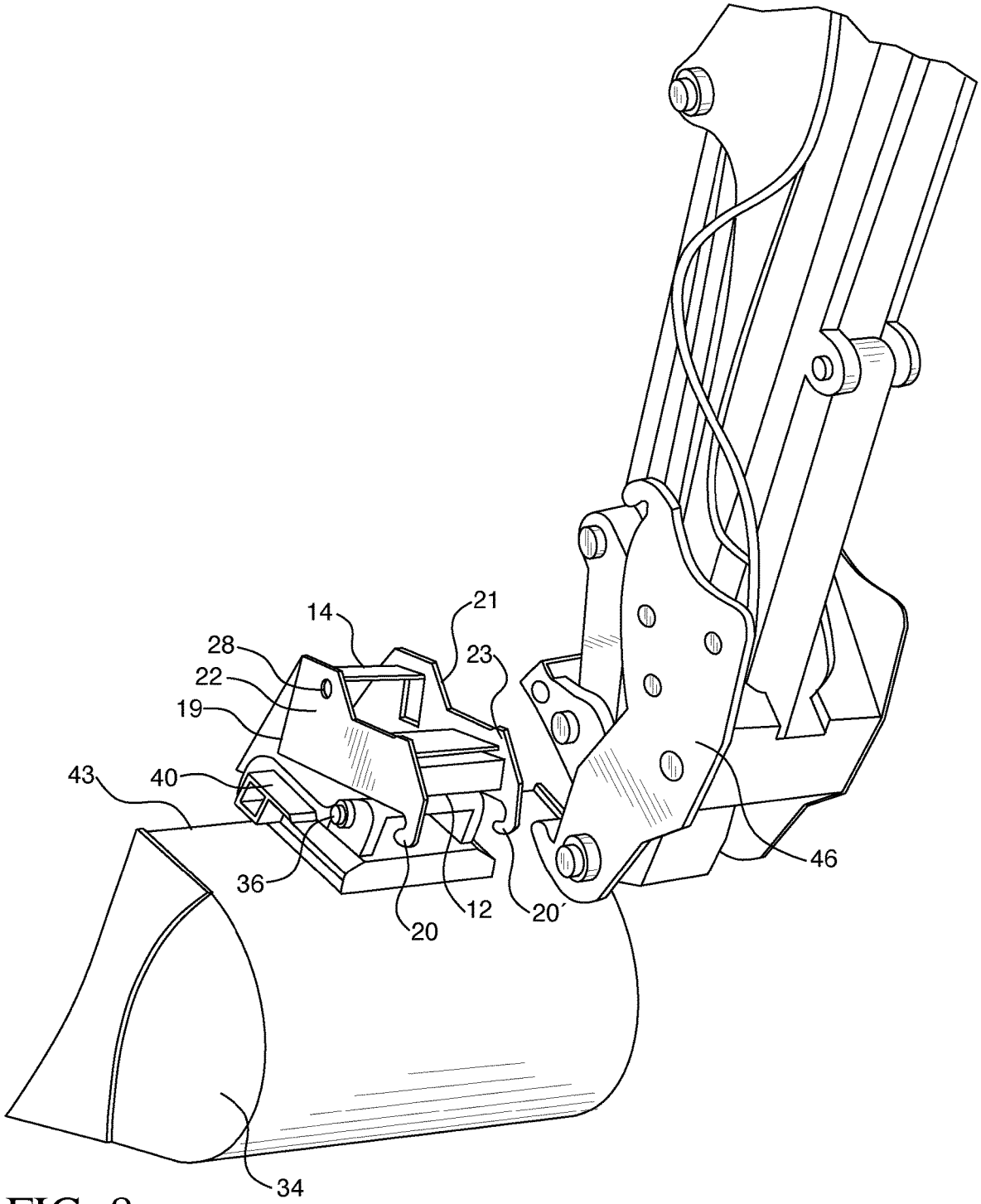
FIG. 8 is a perspective view of the first and front side of the reversible bucket coupler device attached to the bucket shown in FIG. 7 prior to attachment to an excavator (partial view) in accordance with an embodiment of the invention.

As in shown in FIGS. 1-6, the reversible bucket coupler device 10 has a front end 12, a rear end, 14, a first side 19, a second side 21, a top end 16, a bottom end 18, a first side excavator panel 22 (best shown in FIG. 2) and a second side excavator panel 23 (best shown in FIG. 3). Each excavator panel 22, 23 has at one end a hook-like excavator coupler 20, 20' and a pin hole 28 near the other end. The reversible bucket coupler device 10 also has a first side bucket panel 26 (best shown in FIG. 2) and a second side bucket panel 27 (best shown in FIG. 3). Each bucket panel 26, 27 has at one end an L-shaped bucket coupler 24, 24' and a pin hole 30 near the other end. In addition, the reversible bucket coupler device includes five transverse attachment and support panels 32*a, b, c, d, e* (best shown in FIG. 1).

The first side excavator panel 22 is positioned in front of the first side bucket panel 26 and the end opposite the first side excavator coupler 20 overlaps part of the first side bucket panel 26. The second side excavator panel 23 is positioned in front of the second side bucket panel 27 and the end opposite the second side excavator coupler 20' overlaps part of the second side bucket panel 27. The first side excavator panel 22 and the first side bucket panel 26 are welded together, and the second side excavator panel 23 and the second side bucket panel 27 are welded together. One end of the five transverse attachment and support panels 32*a, b, c, d, e* are welded to the first side excavator 22 and bucket panels 26 and at the other end of the five transverse attachment and support panels 32*a, b, c, d, e* are welded to the second side excavator 23 and bucket panels 27. Each of the five attachment and transverse support panels 32*a, b, c, d, e* is located in a different area of the reversible bucket coupler 10 to allow optimal attachment of the first side panels 22, 26 to the second side panels 23, 27 as well as providing optimal strength to the device 10.

Figure 9:
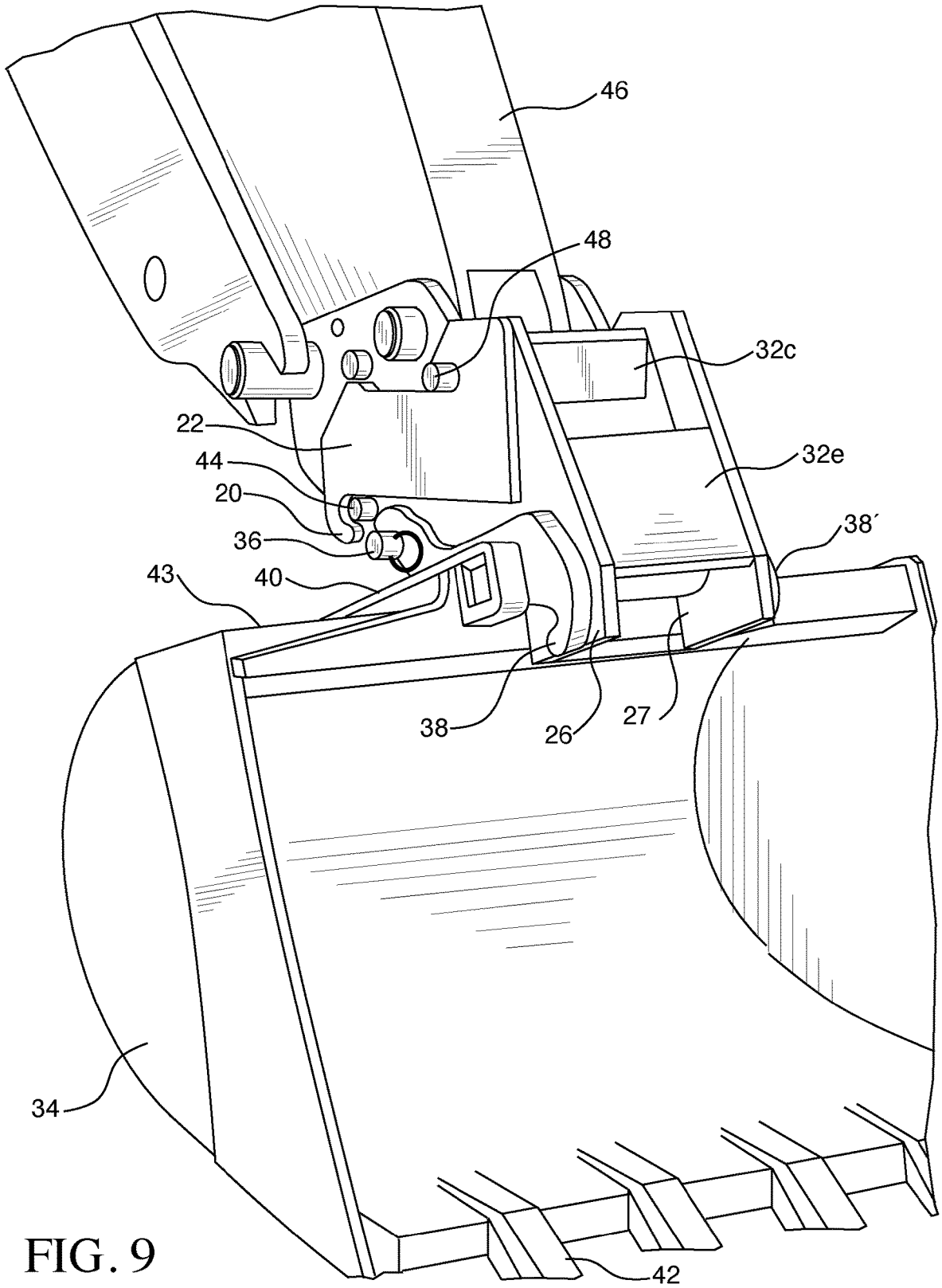
FIG. 9 is a perspective view of the rear end of the reversible bucket coupler device attached to the bucket shown in FIG. 7 and to an excavator (partial view) in accordance with an embodiment of the invention.

As shown in FIGS. 7-10, the L-shaped bucket couplers 24, 24' are configured to attach to a bucket 34 at an end 43 opposite to where bucket teeth 42 of the bucket 34 are located (best shown in FIG. 9). The bucket end 43 has two flanges 40 (only one shown) attached to the end 43 of the bucket 34. Each of the two flanges 40 has a curved portion on one end 38, 38' and a flange pin hole (not shown) near the other end. The bucket couplers 24, 24' attach to the end of the bucket 43 opposite the bucket teeth 42 by engaging onto an area located between the curved portions 38, 38' of the two flanges 40. The bucket couplers 24, 24' are secured to the bucket 34 by placing a bucket pin 36 through the flange pin holes and the bucket pin holes 30.

Figure 10:
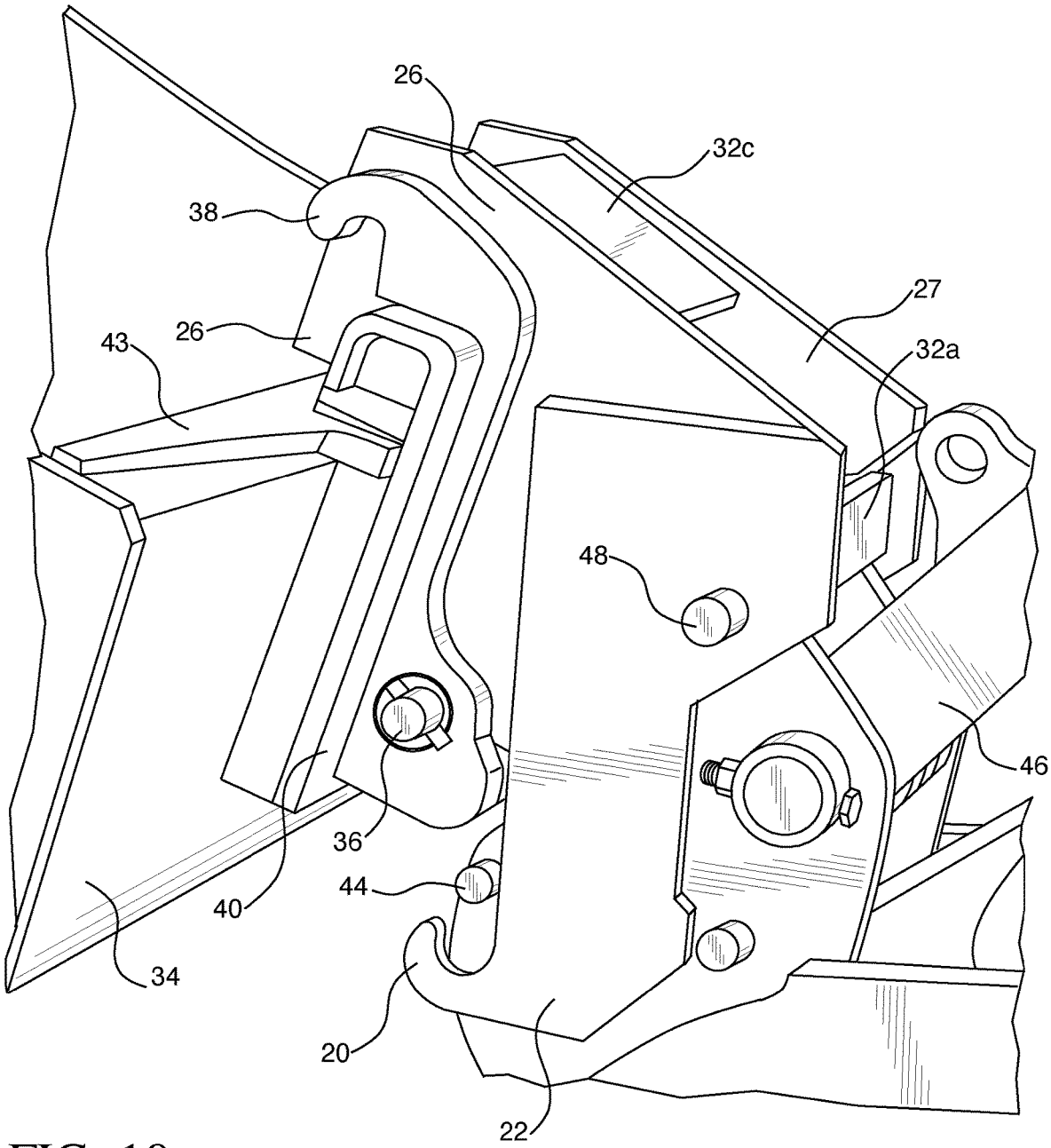
FIG. 10 is a perspective view of the first side of the reversible bucket coupler device attached to the bucket (partial view) shown in FIG. 7 and to an excavator (partial view) in accordance with an embodiment of the invention.

The hook-like excavator couplers 20, 20'are configured to attach to an excavator 46 by placing the excavator couplers 20, 20' around an excavator joint 44 located on an excavator (best shown in FIG. 10). The excavator couplers 20, 20' are secured to the excavator 46 by placing an excavator pin 48 through the excavator pin holes 28 and pin holes located on the excavator (not shown).

In use, an operator of an excavator first installs the reversible bucket coupler device onto a bucket by positioning the L-shaped bucket couplers of the coupler device between the curved portions of the two flanges located on the bucket end opposite the bucket teeth. The bucket couplers then are secured to the bucket by placing a bucket pin through the flange pin holes and the bucket pin holes. The operator then installs the coupler device onto an excavator by placing the excavator couplers around an excavator joint located on the excavator. The two excavator couplers then are secured to the excavator by placing a pin through the excavator pin holes and pin holes located on the excavator.

While specific embodiments have been described in detail, it will be appreciated by those skilled in the art that various modifications and alternatives to those details could be developed in light of the overall teachings of the disclosure. Accordingly, the particular embodiments disclosed are meant to be illustrative only and not limiting as to the scope of the device and method described herein, which is to be given the full breadth of the appended claims and any and all equivalents thereof

What is claimed is:

1. A reversible bucket coupler device for reversing the orientation of a bucket with respect to an excavator so that bucket teeth of the bucket are facing away from the excavator, comprising:

a first side excavator panel and a second side excavator panel, each excavator attachment panel having at one end a hook-like excavator coupler and a pin hole near the other end;

a first side bucket panel and a second side bucket panel, each bucket panel having at one end an L-shaped bucket coupler and a pin hole near the other end, wherein the first side excavator panel and the first side bucket panel are welded together, wherein the second side excavator panel and the second side bucket panel are welded together; and a plurality of transverse attachment and support panels, wherein one end of the plurality of transverse attachment and support panels is welded to the first side excavator and bucket panels at a plurality of areas and the other end of the plurality of transverse attachment and support panels is welded to the second side excavator and bucket panels at the same plurality of areas.

2. The reversible bucket coupler device of claim 1, wherein the first side excavator panel is positioned in front of the first side bucket panel and the end opposite the first side excavator coupler partially overlaps the first side bucket panel.

3. The reversible bucket coupler device of claim 1, wherein the second side excavator panel is positioned in front of the second side bucket panel and the end opposite the second side excavator coupler partially overlaps the second side bucket panel.

4. The reversible bucket coupler device of claim 1, wherein five transverse attachment and support panels are welded to the first side excavator and bucket panels and to the second side excavator and bucket panels, each of the five attachment and transverse support panels located in a different area of the reversible bucket coupler.

5. The reversible bucket coupler device of claim 1, wherein the L-shaped bucket couplers are configured to attach to a bucket at an end opposite to where bucket teeth of the bucket are located, said end having two flanges attached thereon, each of the two flanges having a curved portion on one end and a pin hole near the other end.

6. The reversible bucket coupler device of claim 5, wherein the bucket couplers attach to the end of the bucket opposite the bucket teeth by engaging onto an area located between the curved portions of the two flanges.

7. The reversible bucket coupler device of claim 5, wherein the bucket couplers are secured to the bucket by placing a pin through the flange pin holes and the bucket pin holes.

8. The reversible bucket coupler device of claim 1, wherein the hook-like excavator couplers are configured to attach to an excavator by placing the excavator couplers around an excavator joint located on an excavator.

9. The reversible bucket coupler device of claim 8, wherein the excavator couplers are secured to the excavator by placing a pin through the excavator pin holes and pin holes located on the excavator.

10. The reversible bucket coupler device of claim 1, wherein the reversible bucket coupler device is constructed of steel plate.

11. A method of using the reversible bucket coupler device of claim 1 in order to reverse the orientation of a bucket with respect to an excavator so that bucket teeth of the bucket are facing away from the excavator, the method comprising:

attaching the L-shaped bucket couplers between two flanges having a curved portion on one end and a pin hole near the other end, each of the two flanges located at an end of a bucket that is opposite an end where bucket teeth of the bucket are located; and attaching the two hook-like excavator couplers to an excavator by placing the excavator couplers around an excavator joint located on an excavator.

12. The method of claim 11, wherein the bucket couplers attach to the end of the bucket opposite the bucket teeth by engaging onto an area located between the curved portions of the two flanges.

13. The reversible bucket coupler device of claim 12, wherein the bucket couplers are secured to the bucket by placing a pin through the flange pin holes and the bucket pin holes.

14. The method of claim 11, wherein the two hook-like excavator couplers attach to an excavator by placing the excavator couplers around an excavator joint located on the excavator.

15. The method of claim 14, wherein the two hook-like excavator couplers are secured to the excavator by placing a pin through the excavator pin holes and pin holes located on the excavator.

16. The method of claim 11, wherein the first side excavator panel is positioned in front of the first side bucket panel and the end opposite the first side excavator coupler overlaps the first side bucket panel.

17. The method of claim 11, wherein the second side excavator panel is positioned in front of the second side bucket panel and the end opposite the second side excavator coupler overlaps the second side bucket panel.

18. The method of claim 11, wherein a plurality of transverse attachment and support panels are welded to the first side excavator and bucket panels and to the second side excavator and bucket panels, each of the plurality of attachment and transverse support panels located in a different area of the reversible bucket coupler.

19. The method of claim 18, wherein five transverse attachment and support panels are welded to the first side excavator and bucket panels and to the second side excavator and bucket panels.

20. The method of claim 11, wherein the reversible bucket coupler device is constructed of steel plate.

* * * * *